United States Patent [19]

Baumann

[11] 4,332,550

[45] Jun. 1, 1982

[54] GAS TORCH HAVING AN IMPROVED VALVE CONSTRUCTION

[75] Inventor: Richard S. Baumann, Glenbeulah, Wis.

[73] Assignee: Western Industries, Inc., Milwaukee, Wis.

[21] Appl. No.: 89,192

[22] Filed: Oct. 29, 1979

[51] Int. Cl.[3] ..... F23D 13/04

[52] U.S. Cl. ..... 431/344; 251/215

[58] Field of Search ..... 431/344; 251/215, 218, 251/121

[56] References Cited

U.S. PATENT DOCUMENTS

| | | | |
|---|---|---|---|
| 2,525,928 | 10/1950 | McRae | 251/218 |
| 3,820,564 | 6/1974 | Wagner | 251/215 |
| 3,994,674 | 11/1976 | Baumann et al. | 431/344 |
| 4,243,377 | 1/1981 | Schmid | 431/344 |

*Primary Examiner*—Carroll B. Dority, Jr.

*Attorney, Agent, or Firm*—Andrus, Sceales, Starke & Sawall

[57] ABSTRACT

An improved valve construction for a gas torch. The torch includes a valve body having a fuel conducting passage which provides communication between a container for pressurized fuel, such as propane, and an outlet tube. An opening in the valve body intersects the gas passage and receives a valve which controls the flow of gas through the passage. The stem of the valve is provided with an external thread which is engaged with an internal thread in the opening, and the outer surface of the valve body bordering the opening is staked to deform the outer portion of the internal thread to prevent the valve from being threaded out of the opening.

1 Claim, 3 Drawing Figures

GAS TORCH HAVING AN IMPROVED VALVE CONSTRUCTION

BACKGROUND OF THE INVENTION

A conventional gas torch, such as a propane torch, includes a valve body having a passage which provides communication between the pressurized gas container and the outlet tube. Flow of the gas through the passage is controlled by a needle valve which is threaded within an opening in the valve body. The outer end of the valve stem projects from the valve body and carries a knob through which the valve can be rotated to adjust the flow of gas through the passage.

To prevent the needle valve from being threaded completely out of the passage, the gas torch, as constructed in the past, has included a lock nut located on the outer surface of the valve body which prevents the valve stem from being threaded out of the valve body. However, it has been found that during shipping and handling, the lock nut may loosen or become disengaged, with the result that the needle valve can be completely unthreaded from the valve body and displaced.

SUMMARY OF THE INVENTION

The invention is directed to an improved valve construction for a gas torch and more particularly to a valve construction which will prevent the valve from being completely unthreaded from the valve body. In the construction of the invention a needle valve is threaded within an opening in the valve body and acts to control the flow of gas through the gas passage to the outlet tube. The needle valve includes a stem having an externally threaded section which is engaged with an internal thread of the opening, and the outer end of the stem projects beyond the valve body and carries a knob, through which the position of the needle valve can be adjusted.

In accordance with the invention, the outer surface of the valve body, bordering the opening, is staked inwardly to deform the outer portion of the internal thread and prevent the valve from being threaded completely out of the opening in the valve body.

The invention thus provides a simple and inexpensive construction for positively retaining the needle valve in the valve body and preventing accidental unthreading and displacement of the needle valve.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figures 1, 2, 3:
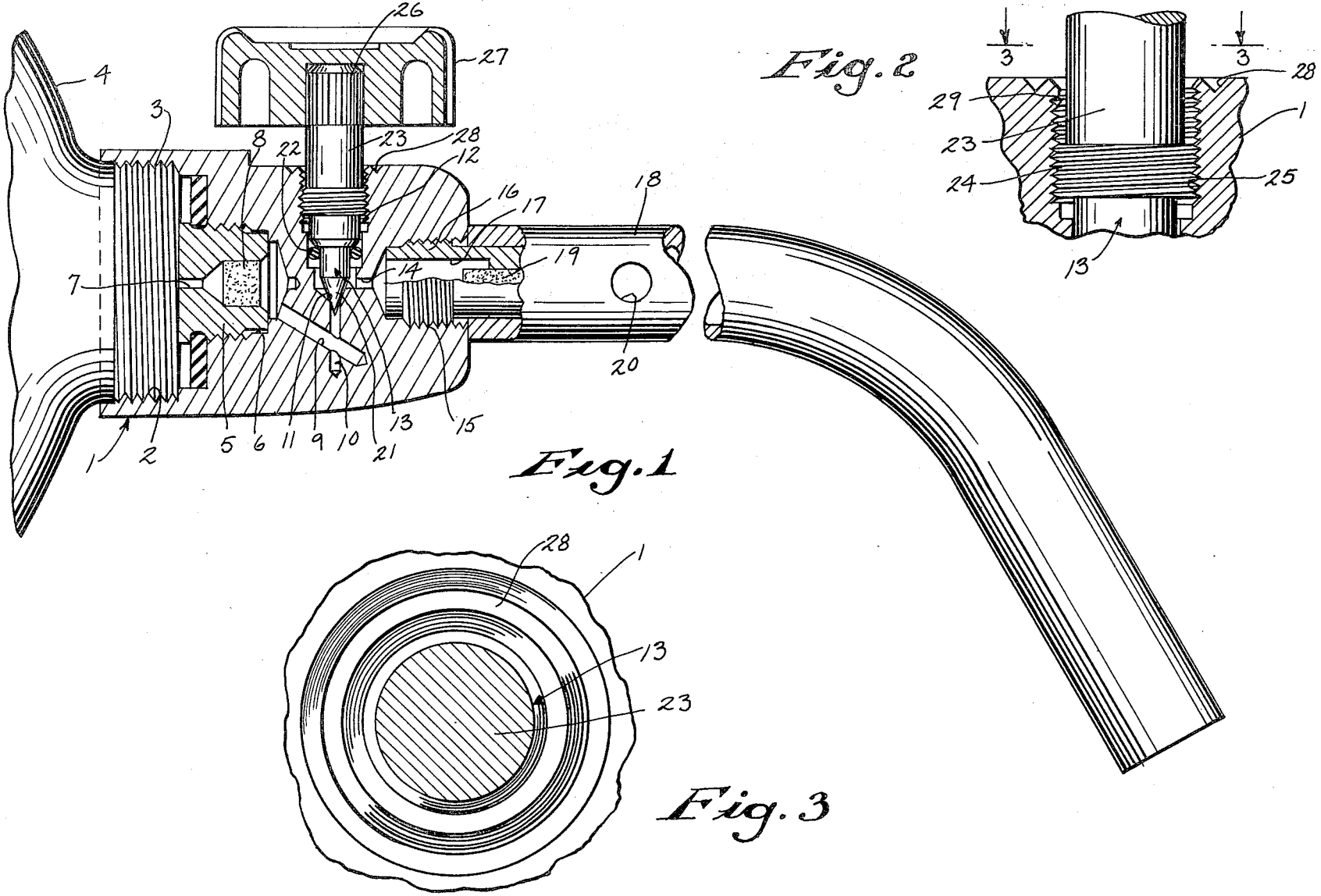
FIG. 1 is a longitudinal section of a gas torch incorporating the valve construction of the invention.
FIG. 2 is an enlarged fragmentary section showing the threaded connection between the valve stem and the valve body.
FIG. 3 is a view taken along line 3—3 of FIG. 2.

FIG. 1 illustrates a portable gas torch incorporating the valve construction of the invention. The torch includes a valve body 1 having a threaded opening 2 which receives the neck 3 of a container 4 that contains a pressurized gas fuel, such as propane. A core 5 is threaded within a recess 6 formed in the base of opening 2 and the core has a central passage 7 that communicates with the interior of the container 4. As shown in FIG. 1, a suitable filter 8 is disposed within the inner portion of the central passage 7.

A diagonal passage 9 extends between the inner end of the recess 6 and a passage 10 which defines a valve seat 11. The passage 10 is connected to an opening 12 that houses a needle valve 13 which controls the flow of gas through the passage 10.

A lateral passage 14 connects the bottom of opening 12 with an opening 15, and a nipple 16 is threaded within the opening 15 and has a central opening 17 which communicates with the outlet tube 18. A filter 19 is located within the opening 17. The flow of gas through the tube 18 creates an aspirating effect to draw air into the tube through a series of ports 20 in the conventional manner.

The needle valve 13 is provided with a generally conical needle 21 which is adapted to seat against the valve seat 11 and an O-ring 22 seals the lower portion of valve stem 23 to the wall bordering opening 12. As best illustrated in FIG. 2, the outer surface of the valve stem 23 is provided with a threaded section 24 which is engaged with the internally threaded section 25 bordering the opening 12. The outer end 26 of the valve stem projects beyond the valve body and is knurled or serrated, and a knob 27 is press fitted onto the end 26. By rotating the knob 27, the needle valve 13 can be threaded within the opening 12 to thereby control the flow of gas between the container 4 and the outlet tube 18.

In accordance with the invention, the outer surface of the valve body 1 bordering the opening 12 is staked, as indicated at 28. The stake is generally triangular in cross-sectional configuration and serves to upset the metal and deform the outer portion of the internal thread 25, as indicated by 29. By deforming the outer portion 29 of the internal thread 25, the needle valve 13 cannot be threaded completely out of the opening 12 and this prevents the accidental displacement of the needle valve from the valve body during shipping and handling.

The stake 28 is shown as extending 360° around the opening 12. While it is not necessary that the stake extend through a full 360°, it is important that it extend through a substantial arc. Considerable torque can be exerted on the needle valve 13 through rotation of the knob 27, and the knob should strip from the serrated end 26 of the valve stem, before the stake is destroyed.

The invention provides a simple and inexpensive method of deforming the outer portion of the threaded connection between the valve stem and the valve body to prevent accidental displacement of the needle valve from the valve body.

Various modes of carrying out the invention are contemplated as being within the scope of the following claims particularly pointing out and distinctly claiming the subject matter which is regarded as the invention.

I claim:

1. A gas torch construction comprising, a valve body to be connected to a container containing pressurized gas, an outlet tube connected to the valve body, passage means extending through the valve body and providing communication between the container and the outlet tube, whereby gas can flow from the container to the outlet tube, said valve body having an opening intersecting said passage means and having an internally threaded section, valve means for controlling the flow of fuel through said passage means and disposed within said opening, said valve means including a stem having an externally threaded section engaged with said internally threaded section, the outer end of said stem projecting outwardly of said valve body in a position to be manually rotated, the outer surface of the valve body bordering said opening having an annular uninterrupted depression, the portion of the valve body between the depression and said opening being depressed inwardly to deform the internal thread inwardly and prevent the external thread of the stem from being completely disengaged from said internal thread.

* * * * *